United States Patent [19]

Schillinger

[11] 4,113,402

[45] Sep. 12, 1978

[54] PRECISION GRADER

[76] Inventor: John D. Schillinger, 2417-29th St., Moline, Ill. 61265

[21] Appl. No.: 822,747

[22] Filed: Aug. 8, 1977

[51] Int. Cl.[2] ..... E01C 23/12

[52] U.S. Cl. ..... 404/91; 299/41

[58] Field of Search ..... 404/90, 91, 83, 72; 299/41, 42, 39

[56] References Cited

U.S. PATENT DOCUMENTS

| | | | |
|---|---|---|---|
| 1,225,547 | 5/1917 | Willson | 404/90 X |
| 1,812,771 | 6/1931 | Blood | 299/41 |
| 2,093,766 | 9/1937 | Rich | 404/90 |
| 2,747,475 | 5/1956 | West | 404/91 |
| 3,148,917 | 9/1964 | Thompson | 299/41 X |
| 3,452,461 | 7/1969 | Hanson | 404/91 X |
| 3,472,555 | 10/1969 | Theermann | 299/41 |
| 3,606,468 | 9/1971 | Walker | 299/39 |
| 3,779,661 | 12/1973 | Godbersen | 404/98 X |
| 3,843,274 | 10/1974 | Gutman | 404/91 |
| 3,893,780 | 7/1975 | Gutman | 404/91 |

*Primary Examiner*—Nile C. Byers

*Attorney, Agent, or Firm*—Glenn H. Antrim

[57] ABSTRACT

A plurality of rotary cutters for pulverizing soil for a subgrade, a conveyor for moving soil from the subgrade, and a leveling blade are connected successively on a slowly moving machine to prepare in a single pass a subgrade for concrete. Blades on the rotary cutter are revolved horizontally and are set at different levels to slice the soil evenly from the bottom of the subgrade and to pulverize the soil. The conveyor may be either a screw or a chain type, and a portion of the conveyor extends across the subgrade behind the rotary cutters. The leveling blade leaves a desired amount of leveled, pulverized soil, and when a screw conveyor is used, pushes the soil into the conveyor.

9 Claims, 11 Drawing Figures

PRECISION GRADER

BACKGROUND OF THE INVENTION

This invention relates to graders and rotary tillers that have cutting blades arranged to revolve about vertical axes, and particularly to precision road graders that have conveyors and leveling blades mounted to follow the rotary cutters for moving pulverized soil laterally and for leveling a desired smaller amount of soil within the newly cut subgrade.

In preparation of subgrades for sidewalks or for roadways, soil to be removed is pulverized by implements such as those having tines that revolve about horizontal axes, and then the pulverized soil is removed by shovels or blade graders. A thin layer of pulverized soil may be desirable at the bottom of the subgrade over which the concrete is to be poured, and this layer of pulverized soil may be leveled at the desired height by blades of simple graders. A usual tilling apparatus for pulverizing the soil has tines revolving about horizontal axes, and the tines to remove clods from the bottom of the subgrade so that the surface of the undisturbed soil is rough. Equipments that have had cutters mounted on vertical axes generally had downwardly directed spikes to be revolved about the axes and therefore did not slice the bottom of the subgrade evenly, and separate equipments were required for removing soil and smoothing the subgrade.

SUMMARY OF THE INVENTION

A precision grader according to the present invention prepares a subgrade ready for concrete by a single slow passage over a strip for the subgrade. For example, equipment suitable for preparing a subgrade for a sidewalk has two rotary cutters beside each other, a conveyor for conveying pulverized soil laterally behind the cutters, and following the conveyor, a leveling blade for leveling the bottom of the subgrade with a small amount of pulverized soil. Vertical shafts for the rotary cutters are spaced transversely on a frame to be coupled to a three-point hitch that is to be attached to the rear end of a tractor. Another frame is pivotally connected to the rear portion of the frame of the cutters for supporting the conveyor and the leveling blade, the leveling blade being adjustable in height.

Blades of the cutters are attached to the periphery of wheels that are connected to the respective spaced vertical shafts. The blades are mounted in pairs, and a required number of pairs may be equally spaced on the periphery of each wheel. One blade of a pair curves upwardly and outwardly above the surface of the wheel, and the other blade curves downwardly and outwardly below the surface of the wheel. In a preferred arrangement, the pairs of blades are located at four equally spaced points about the wheel, two pairs of blades being similar in that the lower blades of the two pairs cut the lowest level of the subgrade, and the other two pairs of blades being positioned to travel at different levels somewhat above the lower level of the subgrade. Since the cutting portions of the blades are approximately horizontal, the blades slice the soil horizontally such that the lower two blades that determine the lowest level at which the soil is pulverized cut a smooth surface on the undisturbed soil. Machines for cutting wider subgrades for roadbeds have a plurality of rotary cutters arranged on each of two spaced lateral lines such that successive cutters across the subgrades overlap sufficiently to provide continuous, smooth cuts across the subgrades.

In the particular embodiment suitable for making subgrades for sidewalks, a screw conveyor with its axis positioned horizontally and laterally follows the rotary cutters. The flight of the conveyor is at a level just above the surface of the ground beside the subgrade such that one end of the conveyor can extend beyond one side of the subgrade for piling pulverized soil along the side.

A leveling blade positioned closely behind the screw conveyor spans the strip in which soil has been pulverized by the preceding rotary cutters. The levling blade performs two important functions. The blade is adjusted to a proper height for leaving a desired amount of leveled, pulverized soil behind the blade, and the soil pushed in front of the blade is raised sufficiently to be moved laterally by the flight of the screw conveyor.

The screw conveyor can be arranged for piling soil on either side of the graded strip. In one arrangement, the screw conveyor extends beyond both sides of the strip, and motors for operating the conveyor are reversible for moving pulverized soil in either lateral direction. In still another arrangement, the flight of the screw is split in the center of the conveyor and the portions at the sides of the conveyor are operated by separate reversible motors. The motors can be operated in the directions for moving the pulverized soil to either side of the graded strip, or they can be operated in the proper opposite directions for moving the pulverized soil from the center outwardly to respective sides of the graded strip. In still another embodiment the conveyor is split in the center to form two sections; the sections are spaced apart; the lower end of an elevating conveyor is placed between the sections; and the elevating conveyor extends rearwardly and upwardly for moving the pulverized soil. In this arrangement, the separated ends of the screw conveyor are operated in opposite directions for moving the pulverized soil toward the center and into the elevating conveyor. Still another chain elevator may be mounted to receive the pulverized soil from the rearwardly extending conveyor for elevating the soil to a greater height and to one side. The lower end of the additional elevator that is directed to one side can be supported below the rearwardly extending elevator by a roller that is hitched to the frame that contains the screw conveyor.

When subgrades that are deeper than about 5 inches (12.7 cm) or a wide subgrade is to be cut, chain conveyors having trencher-type blades may be used in place of the screw conveyors for moving pulverized soil laterally. A horizontal section of chain conveyor can be positioned behind the rotary cutters in place of the screw conveyor in any of the embodiments described above, and a respective portion slanting from one side of the horizontal portion conveys soil to that side of the grade. In another embodiment, a slanting portion extends from each side of the horizontal portion of the conveyor; the frames for the side portions are pivoted; and a lever arrangement rotates the side portions simultaneously about respective pivots at the ends of the horizontal portion to increase the slope of one side while decreasing the slope of the other. At each position where a blade is to be fastened to the chain of the conveyor, a pair of oppositely curved blades is fastened to convey soil in either direction according to the direction of the movement of the chain of the conveyor. Therefore, by using a reversible driving motor, pulverized soil can be moved to a selected side, and the slope of the slanting portion of the conveyor for that side can be adjusted as desired.

DESCRIPTION OF THE PREFERRED EMBODIMENTS

Figure 1:
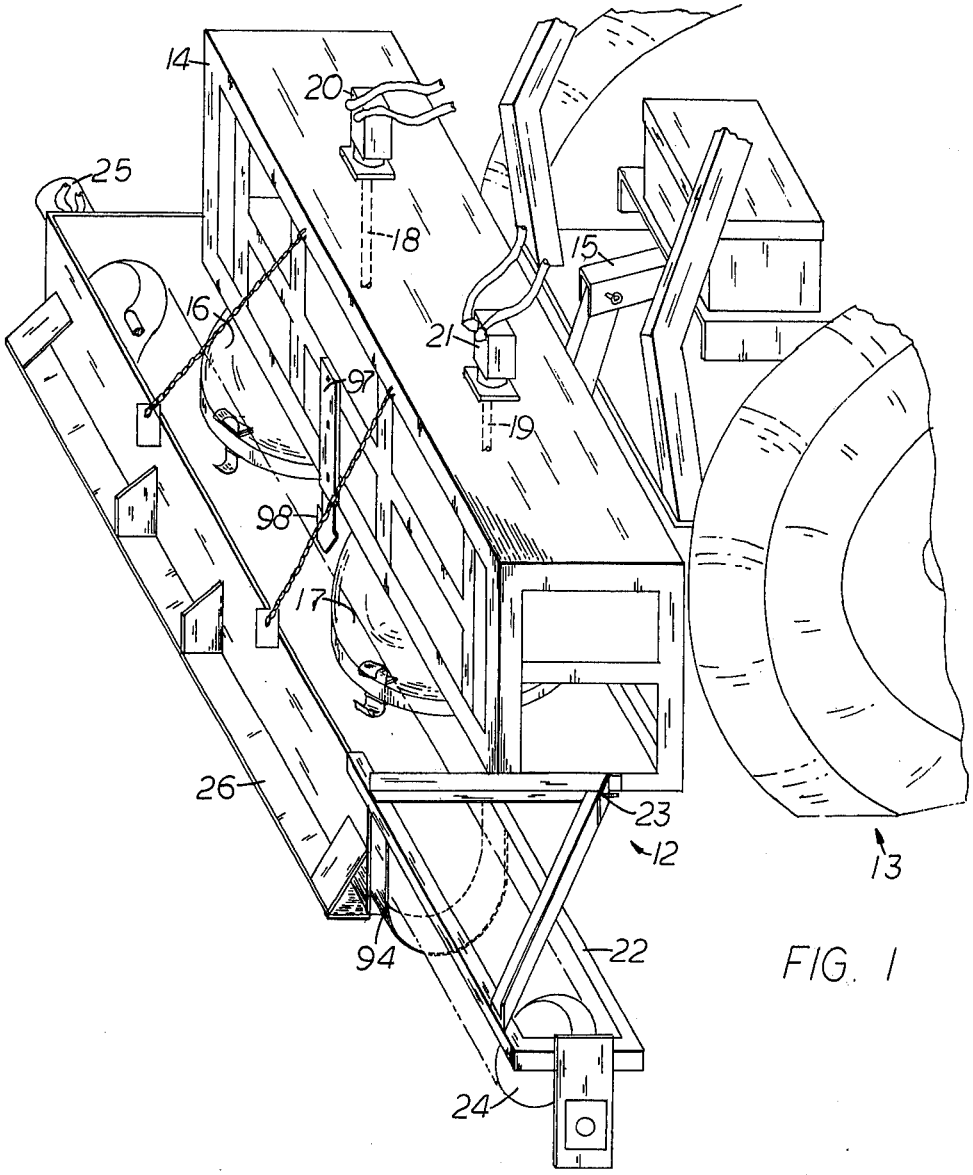
FIG. 1 is a perspective rear view of a precision grader connected by a three-point hitch to the rear of a tractor.

According to FIG. 1, a precision grader 12 receives power from a tractor 13 to cut with a single passage subgrade for a sidewalk. An elongated rectangular frame 14 across the front of the grader 12 is positioned laterally behind the tractor 13, and is connected to the tractor by a conventional three-point hitch as represented by a member 15. The hitch is controllable for positioning the frame 14 at a desirable height and at a desirable slant in a lateral direction while the grader is in operation, and to raise the grader to be transported. Rotary cutters 16 and 17, left and right respectively as viewed from the rear, below the frame 14 are secured to respective vertical shafts 18 and 19 that are rotatively mounted at spaced positions along the frame 14. The left rotary cutter 16 is preferably rotated clockwise, as viewed from above, by a hydraulic motor 20 having its output connected to the upper end of the shaft 18 and its input connected to the hydraulic system of the tractor 13; and the other rotary cutter 17 is rotated counterclockwise by a hydraulic motor 21.

A frame 22 for a conveyor and a leveling blade is positioned behind the frame 14 at a level below the frame 14 and is connected to the frame 14 by pivots 23. A conveyor screw 24 is rotatively mounted within the frame 22, and one end of the frame 22 and the screw 24 extend beyond one side of the frame 14, in this instance to the right side as viewed from the rear. A hydraulic motor 25 has its input connected to the hydraulic system of the tractor 13 and its output connected to one end of a shaft of the conveyor screw 24. A leveling blade 26 is attached to the rear portion of the frame 22 such that its lower edge follows below the conveyor screw 24 at the level of the finished grade. The blade extends across the full width of the grade and finishes the grades smoothly at a desired height.

Figure 2:
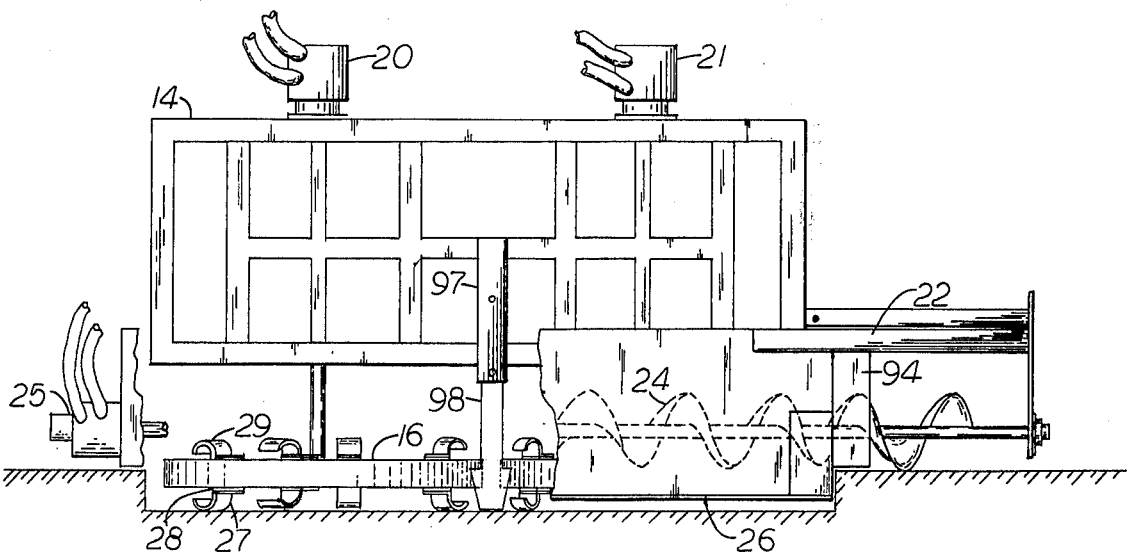
FIG. 2 is a rear view of the grader of FIG. 1 with a portion cut away to show the levels of various components while cutting a subgrade.
Figure 3:
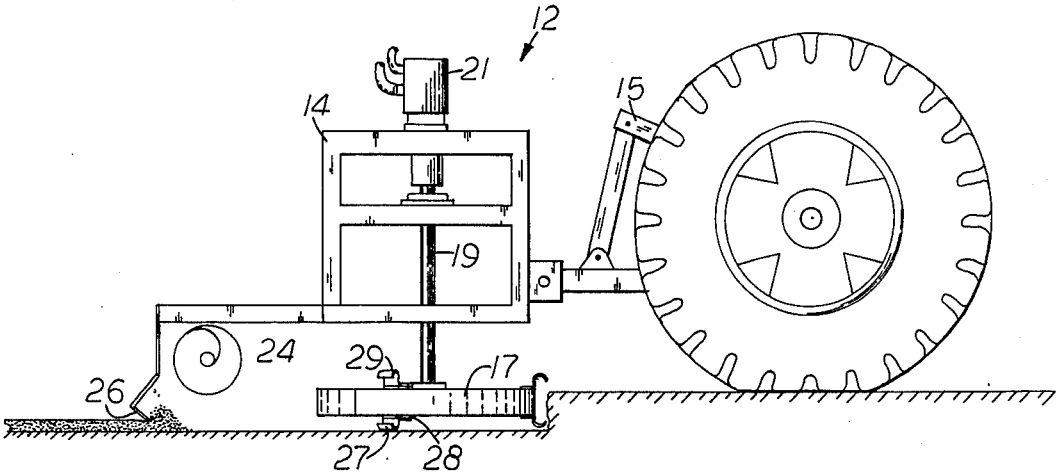
FIG. 3 is a longitudinal, cross-sectional view of the grader of FIG. 1 to show further the relative heights of the undisturbed soil, the components, and the subgrade.

The different heights of either one of the cutters 16 or 17, the conveyor screw 24, and the leveling blade 26 with respect to each other and to the surface of the ground while the machine is in operation can be seen with reference to FIGS. 2 and 3. When four pairs of blades are used on the rotary cutter 16, two pairs have lower blades 27 positioned at the lowest level at which soil is to be pulverized. All the blades for the rotary cutters 16 and 17 may be alike, and the different cutting heights are determined by the number of spacers placed between the blades and the adjacent face of the wheel of the cutters 16 and 17. For example, a maximum number of spacers 28 is placed between the blade 27 and the wheel, and the same number of spacers is used for a similar blade that is positioned diametrically across the wheel of the cutter 16. An upper blade 29 opposite each of the blades 27 is mounted adjacent the upper surface of the wheel of the cutter 16. The other two pairs of blades of four pairs have different numbers of spacers between the blades and the wheels so that the heights are staggered. Either the tractor 13 is to be geared for a very low speed, or a winch is to be used at the front of the tractor to pull the grader 12 forward slowly within the range of 1 to 10 feet per minute. As described above, the rotary cutters 16 and 17 are rotated in such direction that the adjacent portions move rearwardly, and during operation, the blades 27 that are positioned at the lowest level slice the soil to provide an even surface at the bottom of the subgrade.

When only two rotary cutters 16 and 17 are used and are mounted on a line normal to the direction of the subgrade, the blades such as blades 27 of the adjacent cutters may not have overlapping paths and therefore, may leave a narrow, central strip of undisturbed soil. In order to cut this strip, a small shovel such as a cultivator blade 98 is mounted to the rear of the frame 14 at the central location for cutting the strip that is left between the rotary cutters 16 and 17. The blade 98 is attached to the lower end of a vertical bar 97 which provides a usual height adjustment.

The lower edge of the leveling blade 26 is above the lower edge of the cutting blade 27 by an amount equal to the depth of a pulverized soil that is to be leveled in the bottom of the subgrade. As the grader 12 is moved forwardly, soil that is pulverized by cutting blades corresponding to blades 27 and 29 is pushed ahead of the leveling blade 26 to raise the top of a pile of soil within the flight of the conveyor screw 24. As shown most clearly in FIG. 2, the height of the screw 24 is sufficient to permit the end that extends beyond the side of the subgrade to move in a path close to the surface of undisturbed soil. The pulverized soil is therefore piled in a row along the edge of the subgrade. Since the blade 26 can be used to raise the pulverized soil only a limited amount, a grader using the screw conveyor is generally limited to cutting grades only about 5 inches (12.7 cm) deep. When deeper subgrades are required, a chain conveyor as described below can be used.

To prevent pulverized soil that is being moved by the screw 24 to the right edge of the subgrade from falling back, a collar 94 on a line with the right edge of the subgrade has front and rear portions extending from the frame 22 downwardly close to the screw 24 and a lower intermediate portion below the screw. The pulverized soil is therefore moved along the screw 24 through the collar 94, but the collar acts as a baffle to prevent the soil as it spreads outwardly from falling back into the subgrade. A similar collar is provided in line with the edge of the subgrade for the portions of the screws that extend beyond the edges of the subgrade according to FIGS. 4 and 5 described below.

Figure 4:
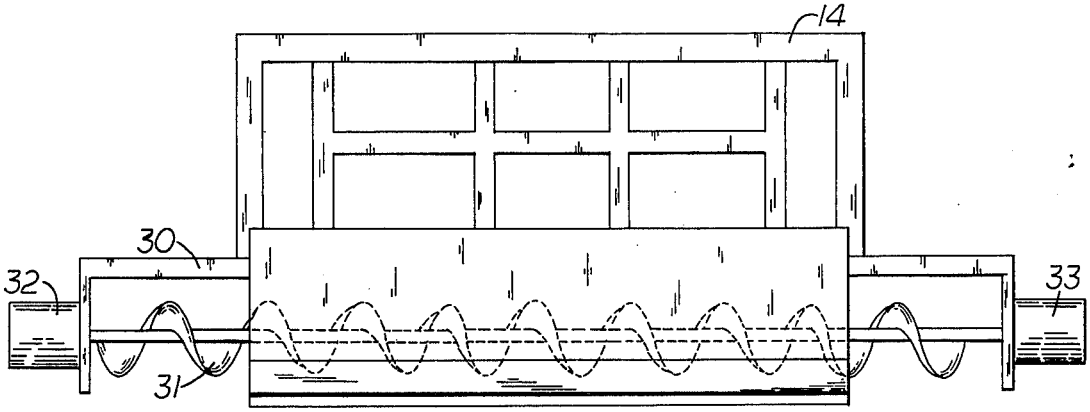
FIG. 4 is a rear view of a modified screw conveyor for use in place of a screw conveyor of FIGS. 1–3.
Figure 5:
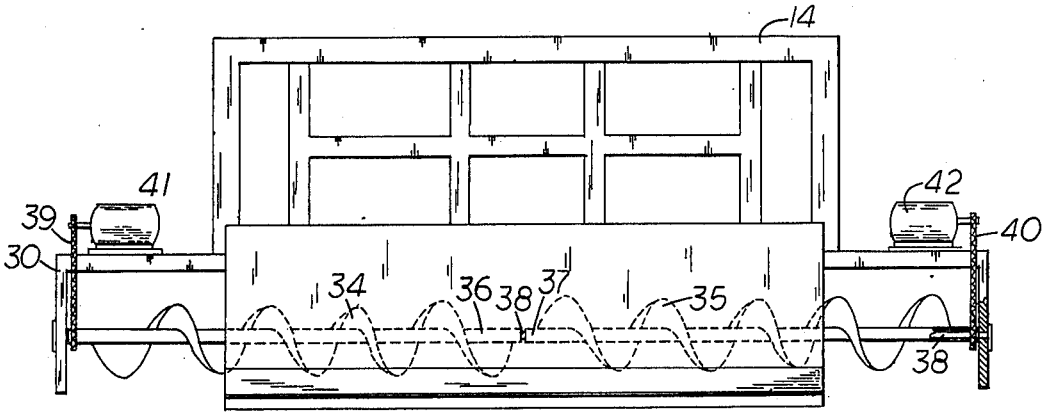
FIG. 5 is a rear view of still another screw conveyor that has separate sections at each side to be rotated by separate reversible motors.

Since banks or other obstructions may be along one side of the strips that are to be graded, the conveyor screw 24 may need to extend beyond the side opposite from that shown in FIGS. 1 and 2. A different frame 22 can be provided with the screw 24 extending beyond the opposite side of the subgrade. The frame 22 having the screw 24 extend in one direction can be readily removed from the frame 14, and a different frame installed. Where both sides of the strip to be graded are free of obstructions, a longer frame 30 having a longer screw 31 as shown in FIG. 4 can be provided for attachment to the frame 14. Reversible motors 32 and 33 may be attached at opposite ends of the shaft of the conveyor screw 31 and operated simultaneously to rotate the screw 31 in either direction for piling pulverized soil in a row along either side of the subgrade. Another arrangement of the conveyor as shown in FIG. 5 either permits soil to be piled on either side in the same manner as the soil is piled by the arrangement of FIG. 4, or permits soil to be piled along both sides simultaneously. Rather than a single section of screw 31 as shown in FIG. 4, the screw of FIG. 5 is divided into the left section 34 and a right section 35 as if the screw 31 of FIG. 4 were split in the center. A solid shaft 38 along the axis of the sections 34 and 35 is fixed between the ends of the frame 30. The flights of the sections 34 and 35 of the conveyor are attached to sleeves 36 and 37 respectively, and the sleeves 36 and 37 are a rotative fit about the shaft 38. The outer ends of the sleeves 36 and 37 are coupled through chain-and-sprocket drives 39 and 40 to the outputs of motors 41 and 42 respectively, the motors 41 and 42 being mounted on the frame 30 above the respective ends of the sections 34 and 35 of the conveyor screw. When the motors 41 and 42 are operated for turning the sections 34 and 35 in the same direction, the embodiment shown in FIG. 5 operates as the embodiment shown in FIG. 4; but the motors 41 and 42 can be operated so that the sections 34 and 35 are rotated in the opposite directions for moving pulverized soil from the center towards the sides.

Figure 6:
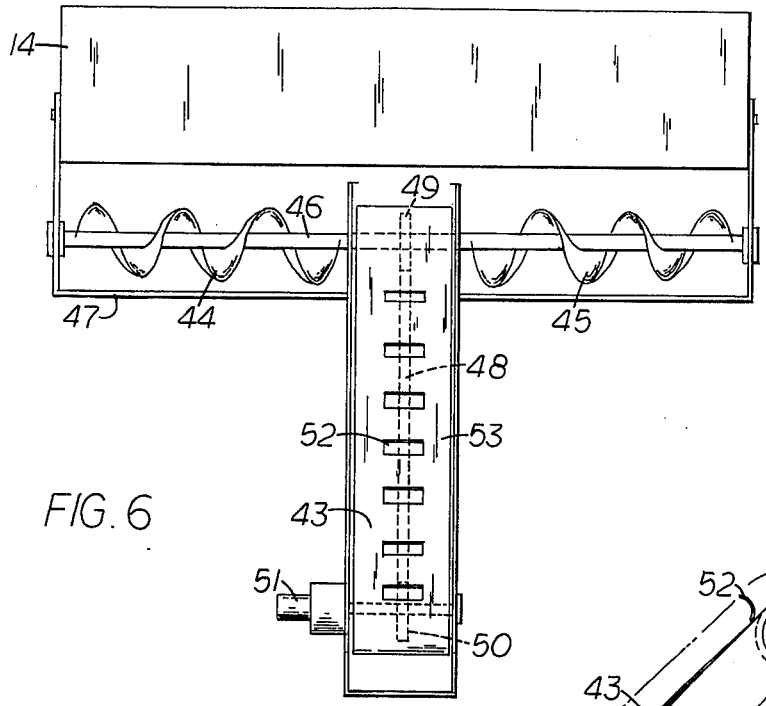
FIG. 6 is a top view of a conveying arrangement comprising a screw conveyor having separate sections with an elevating conveyor positioned between the sections.

In the embodiments shown in FIGS. 1–5, provisions are made for piling pulverized soil in rows along a side or along both sides of a subgrade. According to the embodiment shown in FIGS. 6 and 7, a chain elevating conveyor 43 extends rearwardly from the central portion of a screw conveyor for raising pulverized soil a short distance. With this arrangement, low conveyances or another elevating chain conveyor for moving soil to the side into a truck may be positioned below the upper end of the conveyor 43. The lateral conveyor screw that is positioned as described above behind the frame 14 has two flights 44 and 45 separated at the middle of a single shaft 46. The shaft 46 is rotatively mounted between the ends of a frame 47, and the frame 47 is pivotally mounted to the frame 14 as described above for the frame 22. The lower end of the chain-type conveyor 43 is positioned between the flights 44 and 45. One of the flights 44 and 45 is a right-hand flight, the other is a left-hand flight, and they are rotated in the direction for moving pulverized soil toward the center within the bottom portion of the chain conveyor 43. The conveyor 43 has a chain 48 over a lower sprocket wheel 49 secured to the shaft 46 and over an upper sprocket wheel 50 secured to a shaft that is connected to a motor 51. The motor 51 drives the chain 48 and the shaft 46 to which the flights 44 and 45 are attached. The elevating conveyor 43 has spaced trencher-type blades 52 spaced along its length to push pulverized soil up a trough 53 that has a bottom and sides along the chain 48.

Figure 7:
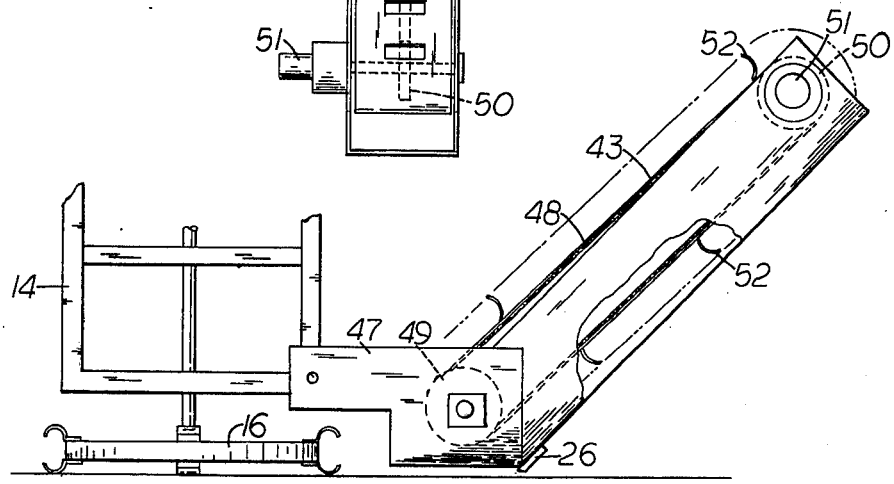
FIG. 7 is a partial, side view of the grader having the conveyors of FIG. 6.
Figure 8:
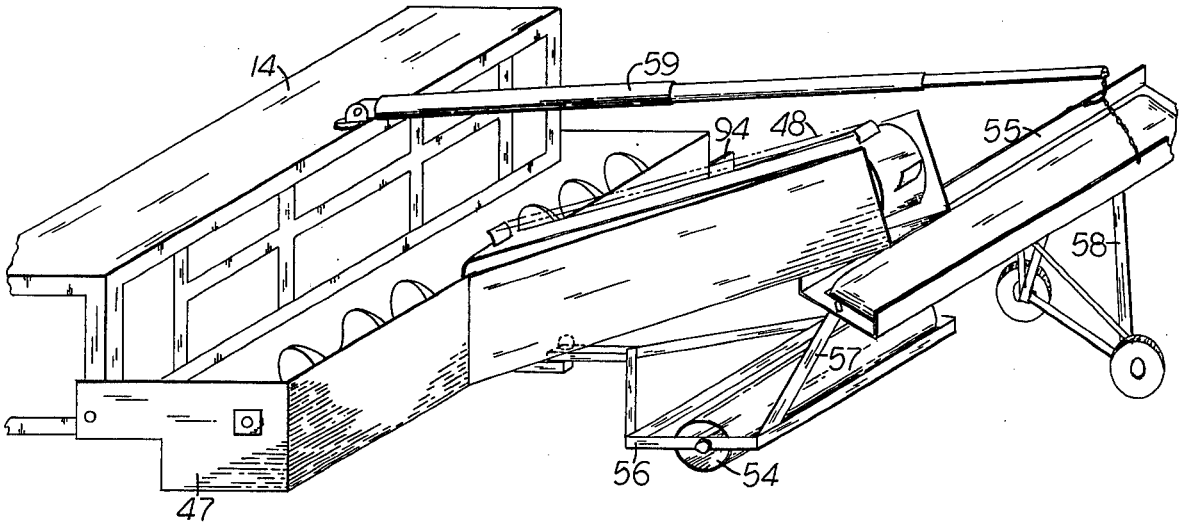
FIG. 8 is a perspective rear view of a system according to FIG. 7 with an additional conveyor for moving pulverized soil to one side.

In order to raise the pulverized soil to a greater height than the height to which it is possible to raise it by the elevating conveyor of FIG. 7 and to convey the soil to the side for loading in a vehicle, a roller 54 shown in FIG. 8 is connected behind the frame 47 for supporting the lower end of an elevating conveyor 55 below the upper end of the conveyor 48, and a trough of the conveyor 55 is directed toward the side of a subgrade. The roller 54 has a frame 56 connected to the frame 47 and an upwardly directed portion 57 to which the lower portion of the frame of the conveyor 55 is pivotally connected. The outer end of the conveyor 55 may be supported on a frame 58 that has wheels that follow beside the subgrade, and the conveyor 55 may be kept at a desired angle with respect to the subgrade by a boom 59 that has one end connected to the middle of the top portion of the frame 14 and the other end connected through chains as a hanger to the upper portions of the sides of the conveyor 55. Preferably, the end of the boom 59 that is connected to the frame 44 is connected by an indexing coupling to permit the boom 59 to be set at a desired angle. The wheels that support the frame 58 may be fixed to turn or have different mounting positions so that when the conveyor 55 is being transported, the wheels are turned 90° from their positions when the conveyor 55 is in operation with a grader.

Figure 9:
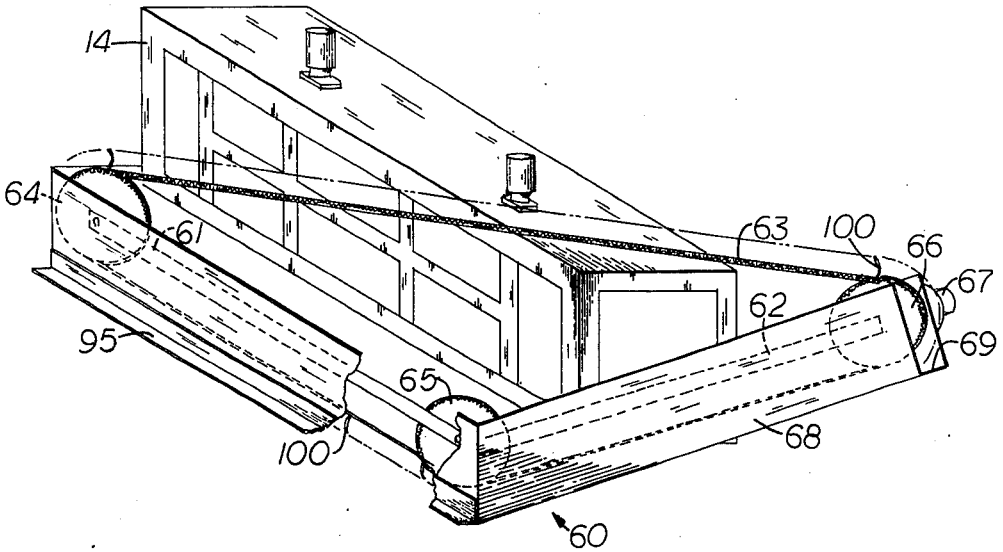
FIG. 9 is a rear perspective view of a grader having a chain conveyor with a horizontal section for replacing the screw conveyors shown in FIG. 1–8.

To provide subgrades of different depths, a chain conveyor having trencher-type blades is substituted for the lateral screw conveyor described above. The lower portion of the chain conveyor is lowered into the subgrade, and therefore, the depth of the subgrade is not limited as for the screw conveyor by the height to which the leveling blade that follows the conveyor can pile the soil pulverized by the rotary cutters 16 and 17. With reference to FIG. 9, a lower portion of a conveyor 60 is installed within a frame 61 that is pivotally connected to the frame 14 of the rotary cutters. A frame 62 slants upwardly and outwardly from one end of the frame 61 to position a chain 63 for depositing pulverized soil at one side of the subgrade. The chain 63 of the elevator 60 engages a sprocket wheel 64 at one end of the frame 61, a sprocket wheel 65 at the other end to which the slanting frame 62 is connected, and the sprocket wheel 66 at the upper, outer end of the slanting frame 62. A motor 67 mounted on the frame 62 coaxially with the sprocket wheel 66 drives the sprocket wheel 66 and the chain 63. Trencher blades 100 spaced along the chain 63 are curved to move pulverized soil in the bottom of a subgrade between the sprocket wheel 64 and 65 toward the elevating portion within the slanting frame 62. A leveling blade 95 extends along the rear portion of the frame 61. The front side of the slanting portion of the chain elevator 60 is open, but the back side has a plate 68 about ½ inch (1.27 cm) back of the rear edges or tips of the trencher blades, and the bottom has a plate 69 about 1 inch (2.54 cm) below the lower edges of the trencher blades. When a small bank and the slanting portion of the chain conveyor 60 are on the same side of the strip that is being graded, the slanting portion of the chain conveyor can remove a moderate amount of the bank as the grader is pulled slowly forward.

Figure 10:
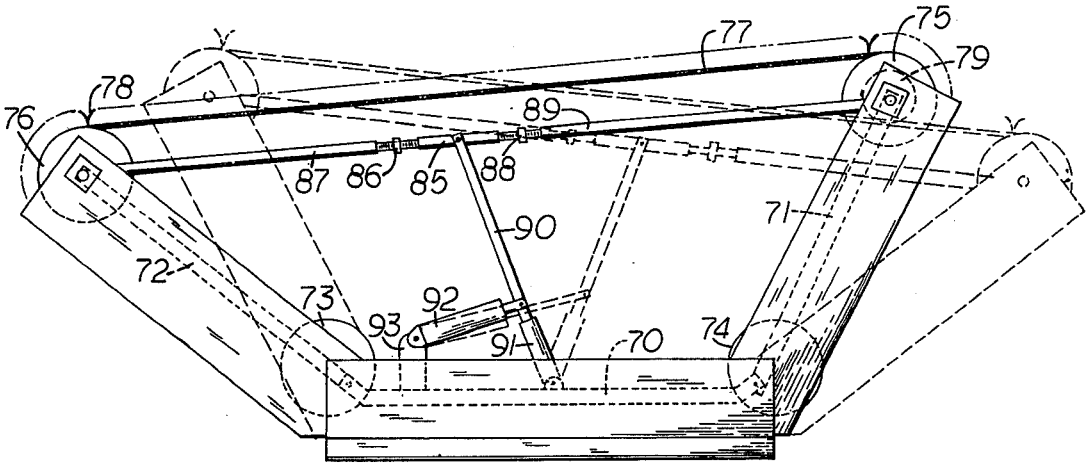
FIG. 10 shows a chain conveyor having a slanting portion at each side rather than at only one side; the portions at each side are adjustable in slope; and blades are positioned to convey pulverized soil in either direction of movement of the chain of the conveyor.
Figure 11:
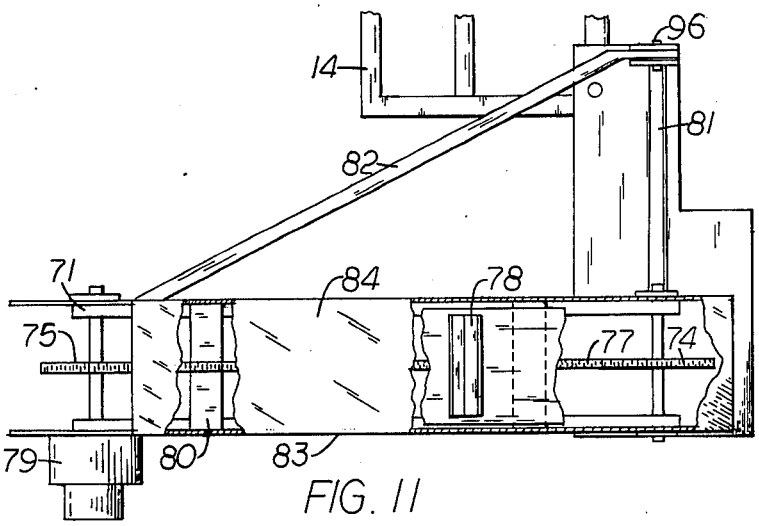
FIG. 11 is a side view of the chain elevator of FIG. 10 showing one of the slanting portions.

The chain conveyor of FIG. 10 can be attached to the frame 14 in place of the chain conveyor of FIG. 9 for selectively piling pulverized soil on either side of the subgrade. In addition to a bottom frame 70 and a slanting end frame 71 corresponding to the frames 61 and 62 respectively of FIG. 9, the chain conveyor of FIG. 10 has an additional slanting frame 72 on an end opposite the frame 71. Sprocket wheels 73, 74, and 75 have positions corresponding to the positions of the sprocket wheels 64, 65, and 66 of FIG. 9, and in addition, a sprocket wheel 76 is mounted at the upper end of the slanting frame 72. A continuous chain 77 is positioned about the four sprocket wheels 73–76 and the blades of each of the pairs of trencher blades 78 across the chain at spaced positions are curved in opposite directions in line with the chain to move soil to either side of a subgrade. A reversible motor 79 mounted on the upper, outer end of the frame 71 is connected to the shaft of the sprocket wheel 75 for driving the sprocket wheel and the chain 77. With reference to FIG. 11, the frame 71 includes longitudinal side members and cross bars or spacers 80 between the longitudinal members. A frame member 81 extends forwardly from the end of the frame 70 along the side of the frame 14 of the rotary cutters. A rigid brace 82 has a pivotal connection 96 at the forward end of the member 81 and extends to the outer, upper end of the frame 71. The pivotal connection 96 is on the axis of a pivot that connects the frame 71 to the frame 70 (FIG. 10). The elevating portion of the conveyor has a back plate 83 and a bottom plate 84 corresponding to the back plate 68 and the bottom plate 69 of FIG. 9.

An assembly (FIG. 10) comprises rigid bars connected end to end to form a crosslink between the upper ends of the frames 71 and 72 of the right and left slanting portions respectively. The assembly of bars can be moved to the left to position the slanting portions of the chain conveyor as shown in the full lines so that the slope of the left portion is substantially less than the slope of the right portion. While the portions of the chain conveyor are rotated to the left positions, the motor 79 is preferably operated in the direction for depositing pulverized soil at the left side of the subgrade. When the pulverized soil is to be deposited at the right side of the subgrade, the assembly of bars is moved to the right to decrease the slope of the right slanting portion and to increase the slope of the left slanting portion, as shown in dashed lines, to help clear obstructions at the left of the subgrade. The crosslink comprises a central portion 85 that is connected through a screw or turn buckle 86 to one end of a bar 87 that is pivotally connected at its other end to the frame 72 of the left slanting portion of the chain conveyor. Likewise, the other end of the central bar 85 is connected through an adjustable screw 88 to a right bar 89 that is pivotally connected to the upper end of the frame 71 of the right portion of the chain conveyor. The screws 86 and 88 are adjusted to tighten the chain 77 as required. A member 90 has one end pivotally connected to the central member 85 and the other end connected through a sleeve 91 to the frame 70 of the horizontal portion of the conveyor. One end of a double acting actuator 92 is pivotally connected to an upright bracket 93 that is connected to the frame 70 and the other end of the actuator 92 is connected to a point above the sleeve 91. Therefore, the slope of the slanting portions of the chain conveyor can be changed in slope by operation of the actuator 92 while the member 90 slides a short distance within the sleeve 91 as the height of the central bar 85 changes with the different positions of the slanting portions of the chain conveyor.

I claim:

1. A machine for preparing precise subgrades comprising:

a plurality of rotary cutters, a screw conveyor, a leveling blade, frame means having a coupling on the front thereof to be connected to a tractor hitch for setting the height and tilt of said frame means and for moving said frame means forward slowly, said rotary cutters being rotatably connected to said frame means side by side thereacross and rotatable below said frame means to pulverize soil within a strip of ground over which said frame means is being moved, said screw conveyor being rotatably mounted across said frame means behind said rotary cutters, said leveling blade being connected across said frame means at the rear thereof closely behind said screw conveyor, said rotary cutters being effective to cut a desired level for a subgrade, said leveling blade having a lower edge at a desired distance above said desired level, said screw conveyor being at least as high as an original grade beside said subgrade and having at least one end thereof extending substantially beyond the strip defined by said cutters as said machine is moved forwardly and therefore during operation positioned over said original grade beside said subgrade, a collar connected to said frame means and fit closely behind and below said screw conveyor at a position in line with an edge of said strip, and said collar having sufficient width to prevent pulverized soil that is being conveyed from said subgrade to said original grade from falling back into said subgrade.

2. A machine as claimed in claim 1 wherein each end of said screw conveyor extends beyond a respective edge of said subgrade, a second collar, one of said collars as a shield disposed about even with each of said edges, and reversible drive means connected to said screw conveyor for piling soil selectively at each side of said strip that is being graded.

3. A machine as claimed in claim 2 wherein said screw conveyor comprises two independently rotatable abutting sections, said reversible drive means comprising a separately controllable reversible drive means connected to each of said sections of said screw conveyor, and said reversible drive means being controllable either for rotating both of said sections of said screw conveyor simultaneously in the respective directions as required to move pulverized soil in the same direction along both of said sections to only one selected side of said strip or to move pulverized soil in one direction along one of said sections and in the opposite direction along the other of said sections outwadly from the center to respective sides of said strip.

4. A machine for preparing precise subgrades comprising:

a plurality of rotary cutters, a screw conveyor having first and second flights, a leveling blade, frame means having a coupling on the front thereof to be connected to a tractor hitch for setting the height and tilt of said frame means and for moving said frame means forward slowly, said rotary cutters being rotatably connected to said frame means side by side thereacross and rotatable below said frame means to pulverize soil within a strip of ground over which said frame means is being moved, said screw conveyor being rotatably connected across said frame means to position said first and second flights in line across said frame means behind said rotary cutters, said flights being separated to provide a space between inner ends thereof, said leveling blade being connected across said frame means at the rear thereof closely behind said screw conveyor, said rotary cutters being effective to cut a desired level for a subgrade, said leveling blade having a lower edge at a desired distance above said desired level, said flights of said screw conveyor being positioned a short distance above said lower edge of said leveling blade, a first elevating conveyor connected to said frame means and having an end positioned in said space between said first and second flights, said screw conveyor and said first elevating conveyor being operable simultaneously as said machine is moved forward, said first and second flights each being operable in a direction for moving excessive pulverized soil accumulated ahead of said leveling blade toward and into said end of said first elevating conveyor, and said first elevating conveyor extending upwardly and rearwardly from said screw conveyor to remove excessive pulverized soil from space in front of said leveling blade.

5. A machine as claimed in claim 4 having a roller and a second elevating conveyor, said roller having a forward hitch connected to said frame means, said roller positioned to be pulled over said subgrade, said roller having a pivotal connector connected to a lower end of said second elevating conveyor to support said lower end below an upper end of said first elevating conveyor for transferring pulverized soil from said first elevating conveyor to said second elevating conveyor, and an outer end of said second elevating conveyor being positioned to deposit pulverized soil outside said subgrade.

6. A machine for preparing a precise subgrade comprising:

a plurality of rotary cutters, a chain conveyor having a horizontal portion and a first elevating portion, a leveling blade, frame means having a coupling on the front thereof to be connected to a tractor hitch for setting the height and tilt of said frame means and for moving said frame means forward slowly, said rotary cutters being rotatably connected to said frame means side by side thereacross and rotatable below said frame means to pulverize soil within a strip of ground over which said frame means is being moved, said horizontal portion of said chain conveyor being mounted across said frame means behind said rotary cutters, said leveling blade being connected across said frame means at the rear thereof closely behind said horizontal portion of said chain conveyor, said rotary cutters being effective to cut to a desired level for a subgrade, said leveling blade having a lower edge at a desired distance above said desired level, said horizontal portion of said chain conveyor being positioned at a height a short distance above the height of said lower edge of said leveling blade, said slanting portion of said chain conveyor being a continuous extension of said horizontal portion of said chain conveyor to extend upwardly and outwardly from the edge of said strip that is being graded over an original grade. Said horizontal portion of said chain conveyor being effective to move excessive pulverized soil that accumulates in front of said leveling blade to said elevating portion, and said elevating portion being effective to move said pulverized soil onto said original grade.

7. A machine as claimed in claim 6 wherein said chain conveyor has a second elevating portion extending beyond the other side of said strip opposite said first elevating portion, driving means connected to said chain conveyor reversible for moving pulverized soil to a selected side of said strip, and said chain conveyor having a plurality of first spaced blades curved toward said one side for moving pulverized soil to said one side and second spaced blades curved toward said other side for moving pulverized soil to said other side of said strip.

8. A machine as claimed in claim 7 wherein said horizontal portion and said first and second elevating portions have a single continuous chain to which said blades are attached, first pivotal means connecting one end of said horizontal portion to the lower end of said first elevating portion, second pivotal means connecting the other end of said horizontal portion to the lower end of said second elevating portion, a rigid crosslink having opposite ends pivotally connected to respective upper ends of said first and said second elevating portions, and means connected between said frame means and said rigid crosslink for moving at will said crosslink substantially longitudinally in a transverse direction with respect to said strip for increasing the slope of either one of said elevating portions while decreasing the slope of the other of said elevating portions.

9. A machine as claimed in claim 8 wherein means for moving said crosslink includes an upright member with an upper end pivotally connected to an intermediate point of said crosslink and a lower end pivotally connected to said frame means, an actuator connected between said frame means and said upright member for moving said crosslink substantially longitudinally, and said upright member having a sliding section to permit required changes in length.

* * * * *